US005248073A

United States Patent [19]

Tschiderer

[11] Patent Number: 5,248,073

[45] Date of Patent: Sep. 28, 1993

[54] ARTICULATING PAPER SENSOR

[75] Inventor: Paul E. Tschiderer, Geneseo, N.Y.

[73] Assignee: Eastman Kodak Company, Rochester, N.Y.

[21] Appl. No.: 884,823

[22] Filed: May 18, 1992

[51] Int. Cl.[5] ..... B65H 20/20

[52] U.S. Cl. ..... 226/74; 226/45; 226/91; 400/616.1

[58] Field of Search ..... 226/74, 75, 45, 91, 226/170, 171; 400/616.1

[56] References Cited

U.S. PATENT DOCUMENTS

| | | | |
|---|---|---|---|
| 3,779,440 | 12/1973 | Casale et al. | 400/616.1 X |
| 4,320,960 | 3/1982 | Ward et al. | 355/14 R |
| 4,359,179 | 11/1982 | Waiss | 226/74 X |
| 4,734,868 | 3/1988 | DeLacy | 400/616.1 X |
| 4,987,448 | 1/1991 | Chikama | 355/205 |
| 5,018,888 | 5/1991 | Nishimura et al. | 226/74 X |
| 5,027,993 | 7/1991 | Ferguson | 226/45 X |
| 5,074,543 | 12/1991 | Lawniczak et al. | 271/207 |
| 5,110,025 | 5/1992 | Unuma | 226/74 |

*Primary Examiner*—Daniel P. Stodola
*Assistant Examiner*—Paul T. Bowen
*Attorney, Agent, or Firm*—Lawrence P. Kessler

[57] ABSTRACT

An articulating paper sensor for sensing the presence of continuous paper in a tractor drive assembly for transporting continuous paper along a travel path. The articulating paper sensor comprises a body having a portion including a sensing element for detecting continuous paper and producing a signal in response to such detection. The body is pivotably attached to the tractor drive assembly. When the tractor drive assembly is positioned to have continuous paper loaded therein, the body is moved to a remote location relative to the continuous paper travel path; and when the tractor drive assembly is positioned to transport continuous paper along the travel path, the body is moved to a location relative to the travel path such that the sensing element detects the presence of continuous paper in the travel path.

4 Claims, 4 Drawing Sheets

ARTICULATING PAPER SENSOR

BACKGROUND OF THE INVENTION

The present invention relates in general to paper sensors, and more particularly, to paper sensors associated with the hold down clips of tractor drive assemblies for fan fold paper.

It is common practice to print information from a computer on an elongated run of paper, typically referred to as a continuous or fan fold paper. Fan fold paper, as is well known in the art, is a continuous strip of paper having regularly spaced perforations along its longitudinal marginal edges to facilitate transport of the paper strip, and transverse alternating folds at predetermined intervals to establish substantially equal sized individual panels which can be folded upon one another. Recent electrostatographic reproduction apparatus have been designed with the capability of copying information contained on either individual documents or fan fold paper. An example of such apparatus is shown in U.S. Pat. No. 5,074,543 (issued Dec. 24, 1991, in the name of Lawniczak et al). In such apparatus, a motor driven tractor assembly is utilized to transport the fan fold paper such that it is fed across the platen of the reproduction apparatus. At appropriate times, the reproduction apparatus is activated in a well known manner to copy information from the individual panels of the fan fold paper.

It is, of course, clear that there must be some cooperative interrelation of the controls between the tractor drive assembly for the transport of fan fold paper and the reproduction apparatus in order to cycle the combined structure to obtain copies of the individual panels of the fan fold paper. In the past, location of sensors for determining the presence of fan fold paper has required that the paper be threaded through the sensors. This presents a potential for damaging the paper. Further, the presence sensors have been remotely located relative to the tractor drive assemblies. This may lead to an improper indication that the fan fold paper has actually been properly received in the tractor assemblies.

SUMMARY OF THE INVENTION

In view of the foregoing discussion, this invention is directed to an articulating paper sensor for sensing the presence of continuous paper in a tractor drive assembly for transporting continuous paper along a travel path. The articulating paper sensor comprises a body having a portion including a sensing element for detecting continuous paper and producing a signal in response to such detection. The body is pivotably attached to the tractor drive assembly. When the tractor drive assembly is positioned to have continuous paper loaded therein, the body is moved to a remote location relative to the continuous paper travel path. and when the tractor drive assembly is positioned to transport continuous paper along the travel path, the body is moved to a location relative to the travel path such that the sensing element detects the presence of continuous paper in the travel path.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
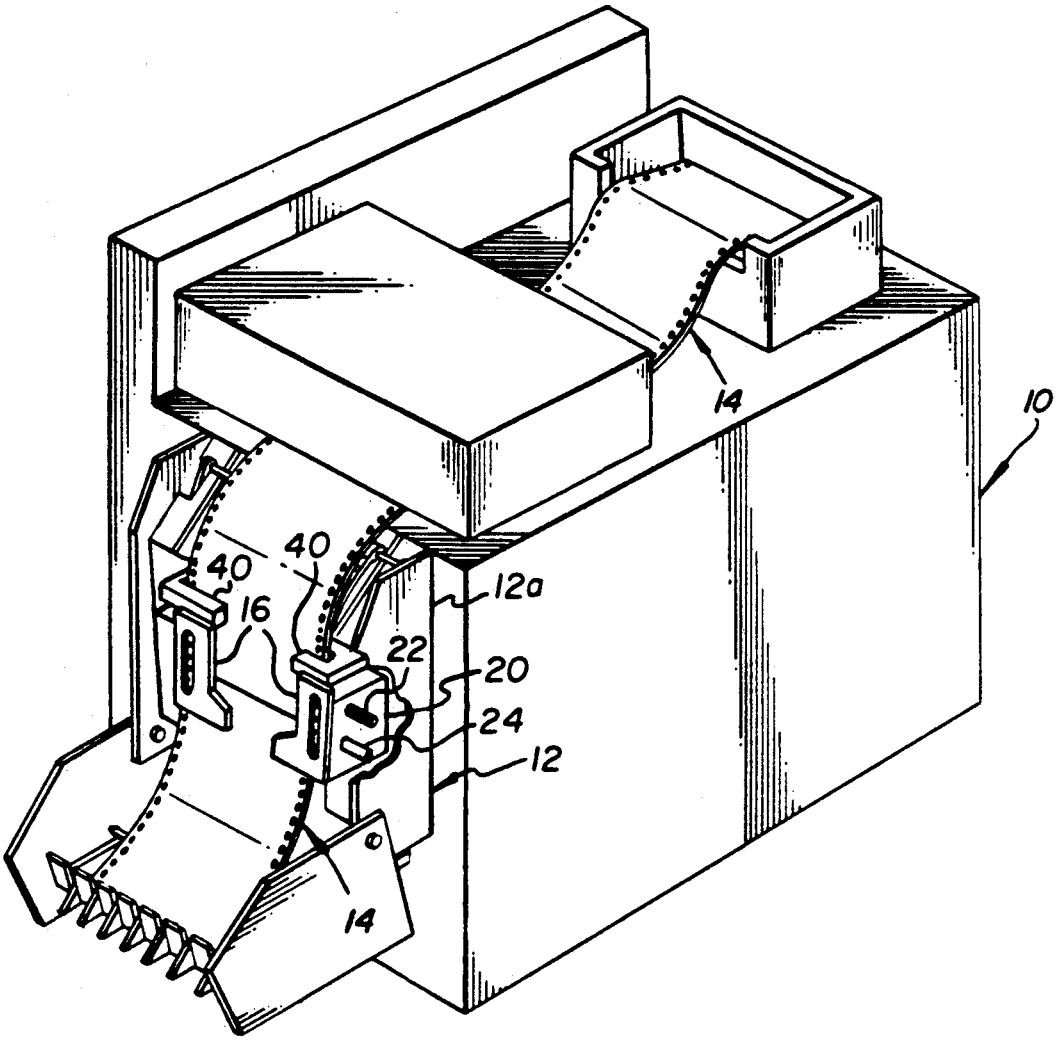
FIG. 1 is a view, in perspective, of a reproduction apparatus including a device for feeding fan fold originals in a manner such that the individual panels thereof may be copied.

Referring now to the accompanying drawings, FIG. 1 shows in generally schematic form an exemplary reproduction apparatus 10 which includes a device 12 for feeding fan fold paper 14 (as defined above) in a manner such that information contained thereon may be copied. Such fan fold feeder device 12, which is more fully shown and described in the aforementioned U.S. Pat. No. 5,074,543, includes a motor driven tractor drive assembly 16 for effecting transport of the fan fold paper 14 in association with the reproduction apparatus such that the information on the individual panels thereof may be copied. The present invention incorporates an articulating paper sensor, designated generally by the numeral 40, for determining the presence of fan fold paper in the tractor drive assembly 16. Of course, the articulating paper sensor 40 according to this invention is suitable for use with any other apparatus of the general type employing similar tractor drive assemblies for transportation of continuous or fan fold paper, such as a printer or writer adapted to reproduce information from a computer.

The tractor drive assembly 16 includes spaced shafts 22 and 24 supported in a frame **12*a* of the fan fold paper feeding device 12. A pair of housings 20 are adjustably mounted on the spaced shafts 22 and 24 for movement along the longitudinal axes of the shafts. The adjustability of the housing 20 in the longitudinal direction along the axes of the shafts 22 and 24** serves to enable the tractor drive assembly to be located to accommodate various widths (measured in the cross-track direction) of the fan fold paper.

Figure 3:
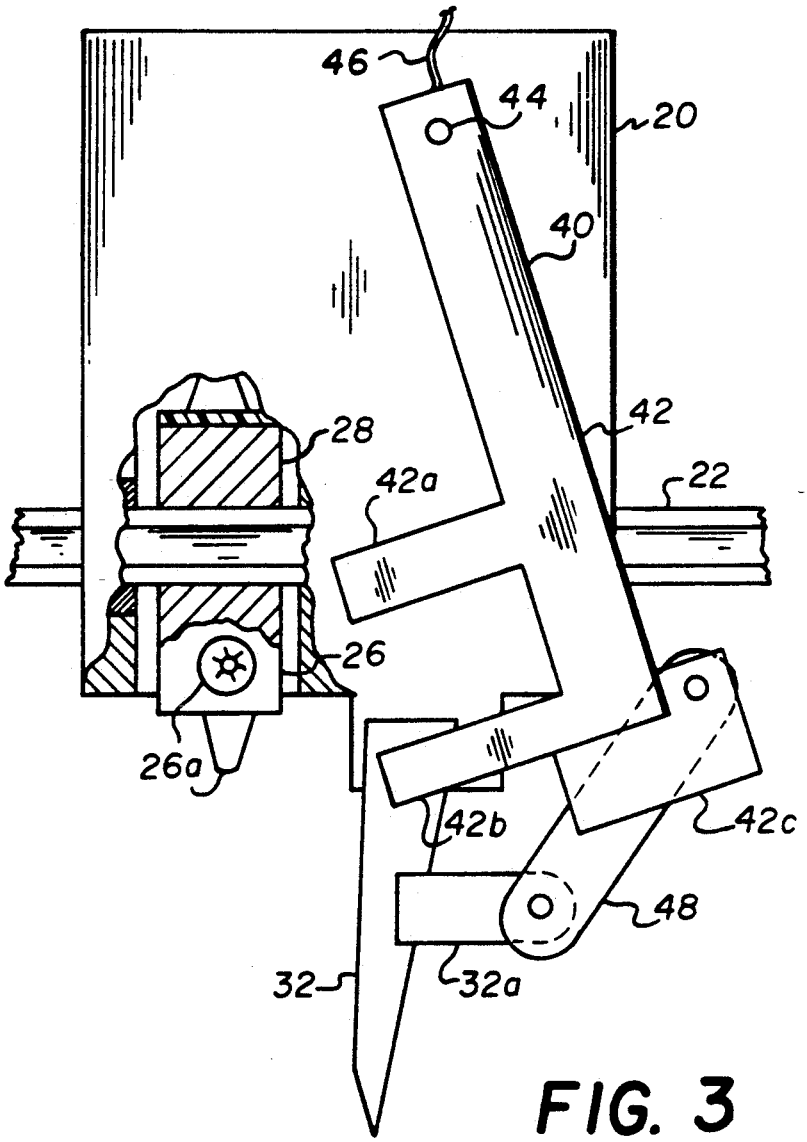
FIG. 3 is a top plan view of the tractor assembly and associated paper sensor of FIG. 2, shown in the closed, paper sensing position, with portions in cross-section or broken away to facilitate viewing.
Figure 4:
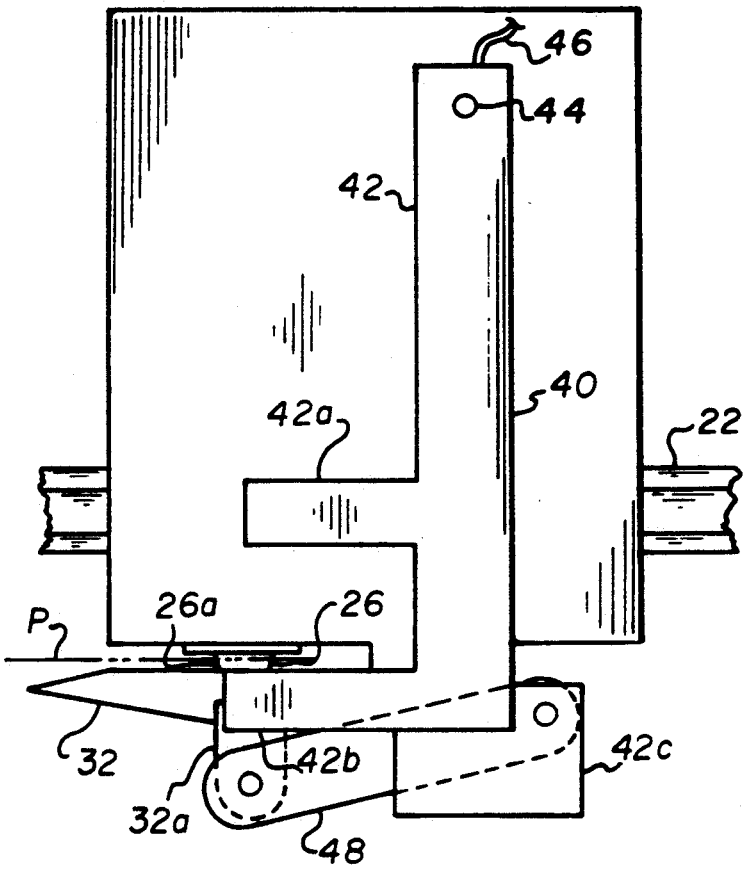
FIG. 4 is top plan view of the tractor assembly and associated paper sensor of FIG. 2, shown in the open position with the sensor located remote to the paper path, with portions in cross-section or broken away to facilitate viewing.

The housings 20 of the tractor drive assembly 16 are mirror images of one another, and as such only one will be described hereinbelow with reference to FIGS. 2–4. The housing 20 is supported by bearings **22*a* and 24*a* on the shafts 22 and 24. The shaft 22 is a drive shaft coupled to a motor (not shown), while the shaft 24 is an idler shaft. A closed loop tractor chain 26 is located within the housing 20 and entrained about a drive sprocket 28 and an idler sprocket (not shown). The drive sprocket 28 is mounted on the drive shaft 22 so as to be adjustable, with the housing 20**, along the longitudinal axis of the drive shaft and rotatably driven thereby when the drive shaft is rotated by its associated motor.

Similarly, the idler sprocket is mounted on the idler shaft 22 so as to be adjustable, with the housing 20, along the longitudinal axis of the idler shaft. The tractor chain 26 has a plurality of pins 26*a* extending substantially outwardly from the chain. The pins 26*a* are spaced apart a distance corresponding to the standard distance between adjacent marginal edge perforations in fan fold paper.

Figure 2:
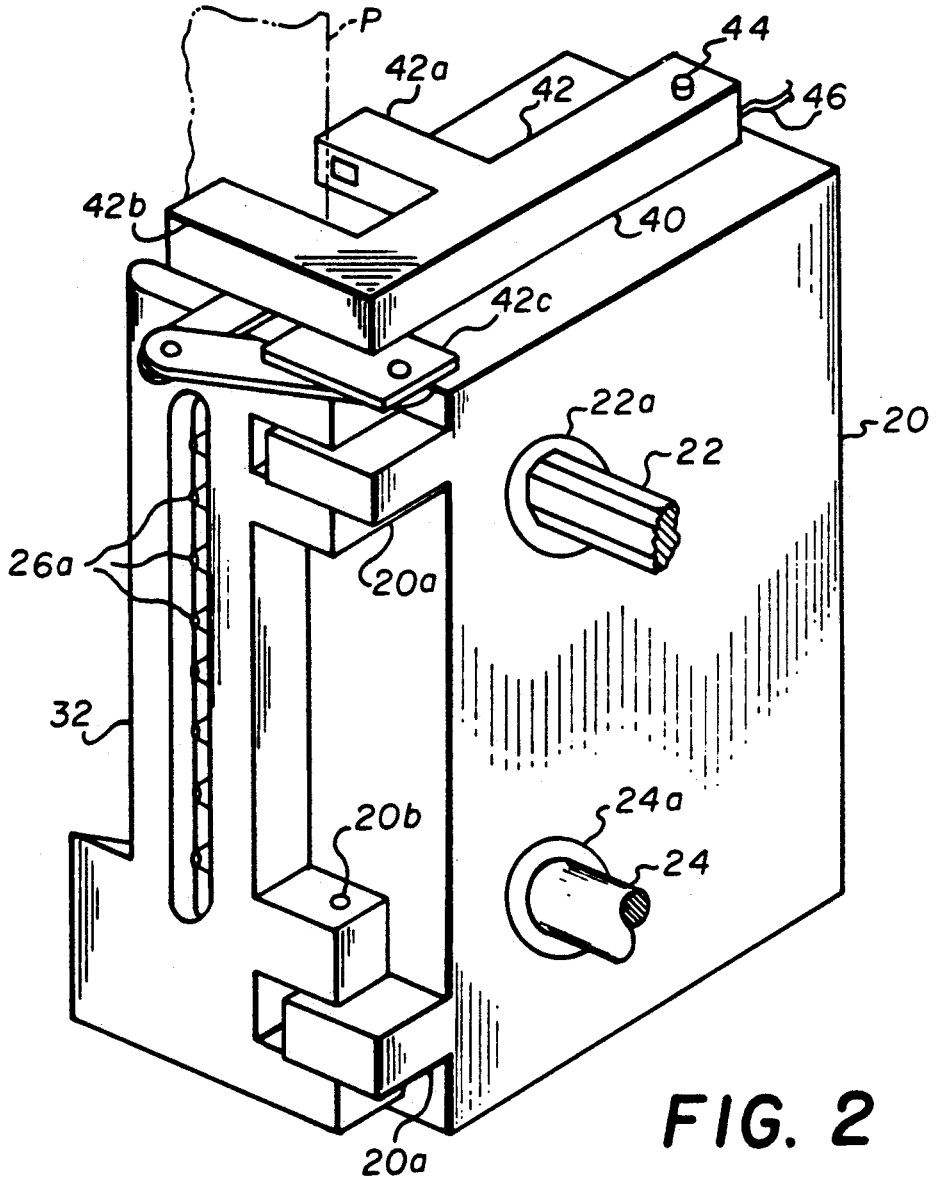
FIG. 2 is a view, in perspective, of a tractor assembly and associated articulating paper sensor according to this invention.

A hold down clip 32 is attached to bosses 20*a* of the housing 20 for pivotable movement about attachment pins 20*b* (only the lowermost pin being shown in FIG. 2). The hold down clip is manually movable to a closed position (see FIGS. 2 and 4) to retain fan fold paper on the pins 26*a* of the tractor chain 26, and to an open position (see FIG. 3) where the pins are readily accessible. An overcenter spring (not shown) maintains the hold down clip 32 in either the open position or the closed position. In the open position for the hold down clip 32, the fan fold paper is readily threadable onto the pins 26*a*. After the fan fold paper is threaded onto the pins, the hold down clip is moved to the closed position to retain the fan fold paper in operative relation with the pins. The broken line P of FIGS. 2 and 4 represent the plane of fan fold paper (and thus its travel path) when operatively associated with the tractor drive assembly 16. Thus, when the drive sprocket 28 is rotated by the motor driven drive shaft 22, the fan fold paper will be advanced by the tractor chain 26. In operation, the fan fold paper is advanced in discrete intervals to advance individual panels thereof into association with the image capture station (not shown) of the reproduction apparatus 10 to enable such individual panels to be copied.

As noted above, it is important for the proper operation of the reproduction apparatus 10 to ascertain whether fan fold paper 14 has been properly received into the tractor drive assembly 16. Accordingly, this invention provides articulating sensors 40, associated with the housings 20 respectively, for detecting the presence of fan fold paper in the tractor drive assembly without interfering with the fan fold paper travel path as the fan fold paper is loaded into the tractor drive assembly. Again, the articulating sensors 40 are mirror images of one another, and as such only one will be described with reference to the FIGS. 2–4. The articulating sensor 40 includes a body 42 pivotably mounted on a pin 44 extending from the housing 20 of the tractor drive assembly 16. The longitudinal axis of the pin 44 is substantially parallel to the longitudinal direction of travel of the fan fold paper in the plane P. The body 42 has portions 42*a* and 42*b* extending substantially perpendicularly from the body. Portions 42*a* and 42*b* contain a paper detector couple, such as for example a light emitter and light detector, respectively. When the sensor 40 is in the detecting position (see FIGS. 2 and 4), the portions 42*a* and 42*b* lie on opposite sides of the plane P of the fan fold paper. The paper detector couple, on detection of paper, produces a signal which is transmitted, such as over lines 46, to the microprocessor based logic and control unit (not shown) of the reproduction apparatus 10 so that the reproduction apparatus has the necessary information that fan fold paper is located in the tractor assemblies for copying individual panels thereof.

The body 42 of the sensor 40 has an extension piece 42*c* coupled to an extension piece 32*a* formed with the hold down clip 32 of the tractor assembly 16 by an elongated link 48. The link 48 is pivotably connected at one end to said extension piece 42*c* and is pivotably connected at its opposite end to the extension piece 32*a*. Accordingly, when the hold down clip 32 is moved to the open position by being manually pivoted about its mounting axis 20*b* with the housing 20, the link 48 urges the sensor 40 about the longitudinal axis of the pin 44 supporting the body 42 on the housing 20 (see FIG. 3). Due to the relative locations of the respective pivot axes, the portions 42*a* and 42*b* of the sensor are moved a sufficient distance to be remote to the path of fan fold paper through the tractor assembly. Thus, the fan fold paper can be readily threaded onto the pins 26*a* without any potentially damaging interference from the sensor 40. Once the fan fold paper is properly threaded onto the pins, the hold down clip 32 is moved to the closed position (see FIG. 4) and the link 48 moves the sensor 40 to the position where the body portions 42*a* and 42*b* straddle the plane P of the fan fold paper path through the tractor drive assembly 16. The sensor 40 is thereby positioned to detect the fan fold paper and produce the appropriate detection signal for the reproduction apparatus logic and control unit.

The invention has been described in detail with particular reference to a preferred embodiment thereof, but it will be understood that variations and modifications can be effected within the spirit and scope of the invention as set forth in the claims.

What is claimed is:

1. In association with a tractor drive assembly including at least one housing, tractor chain, and hold down clip attached to said housing for pivotal movement to an open position remote from said tractor chain for loading fan fold paper thereon and a closed position for holding fan fold paper in operative association with said tractor chain such that fan fold paper can be transported along a travel path, an articulating paper sensor for sensing the presence of fan fold paper in said tractor drive assembly, said articulating paper sensor comprising:

a body having a portion including a sensing element for detecting fan fold paper and producing a signal in response to such detection, said body being pivotably attached to said housing of said tractor drive assembly;

an elongated link pivotably connected at one end to said body and pivotably connected at its opposite end to said tractor drive assembly hold down clip, for moving said body to a remote location relative to said fan fold paper travel path when said hold down clip is located in its open position to have fan fold paper loaded on said tractor chain, and moving said body to a location relative to said travel path when said hold down clip is located in its closed position to enable said tractor drive assembly to transport fan fold paper along said travel path such that said sensing element detects the presence of fan fold paper in said travel path.

2. The articulating paper sensor of claim 1 wherein said housing includes a pivot pin extending therefrom, said pivot pin having a longitudinal axis substantially parallel to the longitudinal direction of travel of fan fold paper along said travel path, and wherein said body is supported adjacent to a first end thereof on said pivot pin for rotation about said longitudinal axis of said pivot pin.

3. The articulating paper sensor of claim 2 wherein said elongated link is pivotably connected at said one end to said body adjacent to a second end of said body substantially opposite said first end thereof.

4. The articulating paper sensor of claim 3 wherein said hold down clip includes an extension piece fixed thereto, and said elongated link is pivotably connected to said extension piece.

* * * * *